US005542535A

United States Patent [19]

Dalton

[11] Patent Number: 5,542,535

[45] Date of Patent: Aug. 6, 1996

[54] FLUORESCENT LAMP CARRIER AND FLUORESCENT LAMP DISPOSAL APPARATUS

[75] Inventor: John Dalton, Spokane, Wash.

[73] Assignee: Square Peg Enterprises, Inc., Spokane, Wash.

[21] Appl. No.: 512,883

[22] Filed: Aug. 9, 1995

[51] Int. Cl.[6] ..... B65D 85/42

[52] U.S. Cl. ..... 206/419; 206/443; 206/523; 182/129; 248/210

[58] Field of Search ..... 206/419, 418, 206/443, 523; 248/210; 182/115, 129

[56] References Cited

U.S. PATENT DOCUMENTS

| | | | |
|---|---|---|---|
| 3,193,095 | 7/1965 | Martino et al. | 206/419 |
| 4,613,042 | 9/1986 | Aeschliman | 206/419 |
| 4,655,404 | 4/1987 | Deklerow | 241/99 |
| 4,662,535 | 5/1987 | Loveland | 220/367 |
| 4,714,162 | 12/1987 | Harrison | 206/419 |
| 4,771,952 | 9/1988 | Speier | 241/99 |
| 4,834,239 | 5/1989 | Osgood | 206/443 |
| 4,858,763 | 8/1989 | Scott | 206/419 |
| 4,953,701 | 9/1990 | Maddock | 206/419 |
| 5,279,389 | 1/1994 | Crockett | 182/129 |
| 5,337,894 | 8/1994 | Ivey | 206/443 |
| 5,351,896 | 10/1994 | Nuttall | 241/99 |

*Primary Examiner*—Paul T. Sewell
*Assistant Examiner*—Luan K. Bui
*Attorney, Agent, or Firm*—Wells, St. John, Roberts, Gregory & Matkin, P.S.

[57] ABSTRACT

A carrier assembly for transporting and supporting fluorescent lamps, the carrier assembly comprising a container including a flexible bag having open and closed ends, the bag having a length between the open and closed ends, and the bag defining a volume; and the container including a tube support, the tube support including first and second parallel spaced apart surfaces, the first and second surfaces being perpendicular to the length of the bag, the first surface having an array of lamp receiving apertures therethrough, the second surface having an array of lamp receiving apertures therethrough which are aligned with the apertures through the first surface, the tube support being attached to the open end of the flexible bag to support and arrange a plurality of fluorescent lamps in spaced apart relation wherein portions of respective lamps extend into the volume in the bag.

19 Claims, 7 Drawing Sheets

FLUORESCENT LAMP CARRIER AND FLUORESCENT LAMP DISPOSAL APPARATUS

TECHNICAL FIELD

The invention relates to lamp carriers for transporting fluorescent lamps and supporting these lamps from a support such as a ladder or a man-lift cage. The invention also relates to fluorescent lamp disposal apparatus.

BACKGROUND OF THE INVENTION

It is known to provide a holder for containing fluorescent lamps (fluorescent tubes) so that a service person need not carry large cartons of fluorescent lamps around buildings to where lamps need changing. It is also known to support lamps from a ladder so that a service person need not carry fragile fluorescent lamps while climbing a ladder, and so that only one service person is needed to remove or install the lamps without having to descend/ascend the ladder. See, for example, the following U.S. patent documents:

U.S. Pat. No. 4,613,042 to Aeschliman (incorporated herein by reference) discloses a lamp holder that can be attached to a step ladder, and that includes several tapered tubular receptacles, and means for keeping fluorescent lamps separated. A clamping arrangement is used to clamp the lamp holder to a ladder. Aeschilman's lamp holder (including both the tapered tubes and the clamp) is rigid, and cannot be collapsed for shipping. Aeschliman's lamp holder also does not provide any handle for transporting the lamps.

U.S. Pat. No. 4,714,162 to Harrison (incorporated herein by reference) discloses a holder for holding fluorescent lamps to a ladder. The holder includes a lower bracket for receiving a lower end of the fluorescent lamps, and an upper bracket for receiving the upper ends of the lamps. Harrison does not provide an apparatus for transporting the lamps. Also, Harrison's holder does not provide any structure for separating lamps from one another.

U.S. Pat. No. 4,858,763 to Scott (incorporated herein by reference) discloses a fluorescent lamp holster 10 having pockets 18, 36 for separately holding fluorescent lamps. The holster can be attached to a user's belt, or to a ladder. The holder also includes a pad 24 at the bottom of the pockets 20 to protect the lamps pins of the fluorescent lamps 22. Scott's holster does not provide any rigid structure for separating the lamps, but instead stores them in adjacent fabric pockets.

It is also known to provide apparatus for disposing of burned out lamps. See, for example, the following U.S. patents:

U.S. Pat. No. 4,662,535 to Loveland (incorporated by reference) discloses a method and apparatus for disposing of burnt out fluorescent lamps, which includes a bendable tube which is permanently closed at one end and includes a removable cap at the other end. A fluorescent lamp to be disposed of is placed within the container, and while confined in the container is broken and reduced to a relatively fine rubble having a small volume. Loveland's apparatus only provides for disposal of a single lamp at a time, and does not provide any disposable enclosure for containing and disposing of broken glass and debris without releasing the debris into the ambient.

U.S. Pat. No. 4,655,404 to Deklerow (incorporated by reference) discloses a motorized fluorescent lamp crusher which prevents discharge of toxic mercury vapors during destruction of the lamps. The crusher employs a filter system which includes an exhaust fan for generating a vacuum at the exhaust opening in the crusher housing, to convey into a special filter any toxic gases, including mercury vapors, which may be released from the lamps as they are shattered. Deklerow's apparatus is relatively complicated, and more expensive than a non-motorized disposal device. It is also relatively difficult to transport. There is also the possibility that some of the small amount of liquid mercury in the lamps may be vaporized by the crushing process.

U.S. Pat. No. 4,771,952 to Speier discloses a fluorescent lamp breaker including a tubular feeding device, a plunger reciprocated vertically by a manually operated crankshaft on a stand, and a bag for receiving broken pieces. The Speier device includes moving parts, and would be expensive to manufacture, and difficult to transport.

U.S. Pat. No. 4,953,701 to Maddock discloses a rigid fluorescent lamp carrier for transporting and assisting in the destruction of burned out lamps. When used lamps are housed in a rigid multi tube container, a pin can be inserted into tiny openings to break the lamps. In a second disposal step, a rod is inserted into each compartment to force down broken glass. Maddock's carrier does not provide any disposable enclosure for containing and disposing of broken glass and debris without releasing the debris into the ambient.

U.S. Pat. No. 5,351,896 to Nuttall discloses a fluorescent lamp breaking apparatus including a housing which receives a fluorescent lamp. The housing includes a guide tube receiving an impact rod for destruction of the lamp. Nuttall's lamp breaking apparatus only provides for disposal of a single lamp at a time, and does not provide any disposable enclosure for containing and disposing of broken glass and debris without releasing the debris into the ambient.

BRIEF DESCRIPTION OF THE DRAWINGS

Preferred embodiments of the invention are described below with reference to the accompanying drawings, which are briefly described below.

DETAILED DESCRIPTION OF THE PREFERRED EMBODIMENTS

Figure 1:
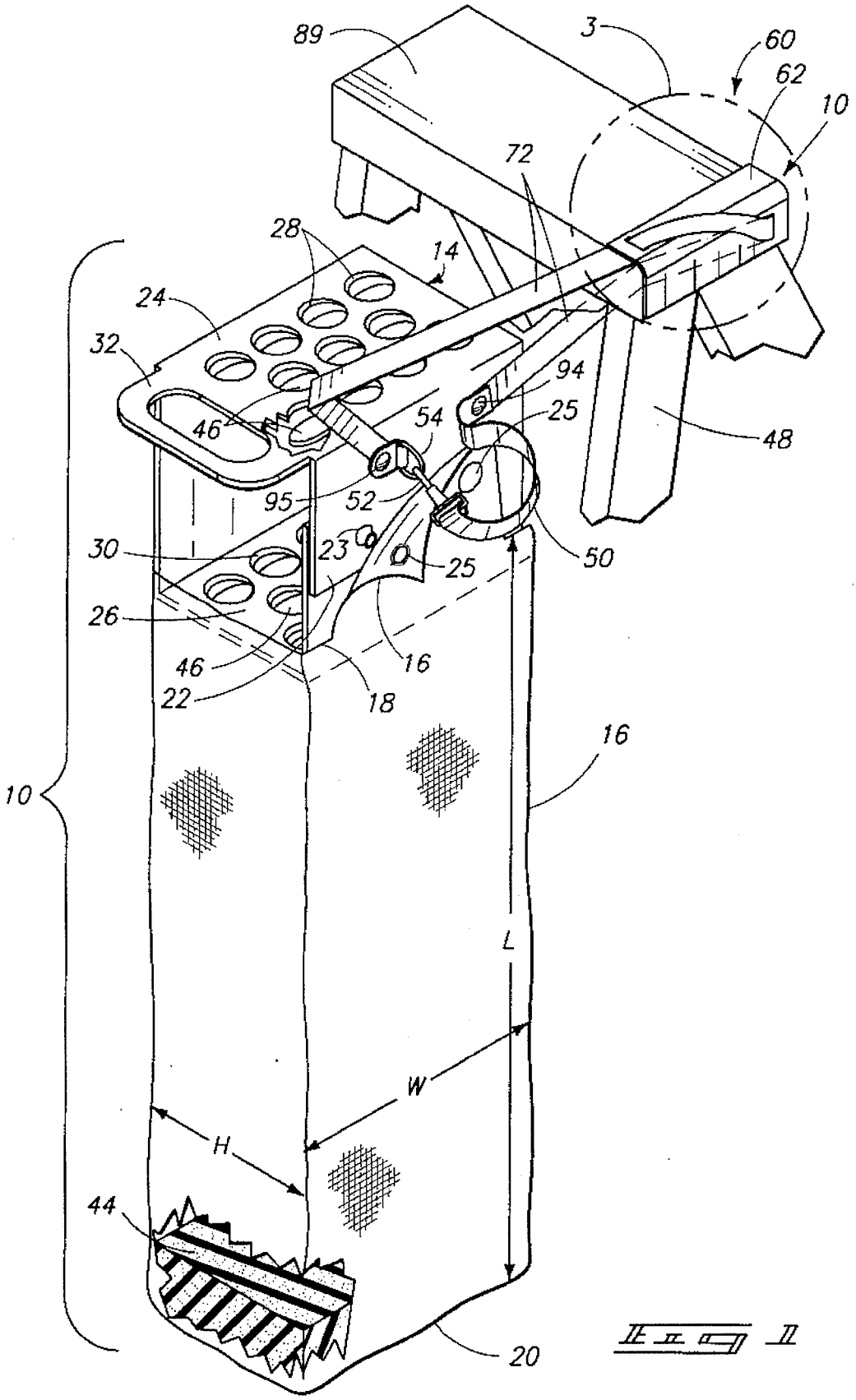
FIG. 1 is a perspective view, partly broken away, of a lamp carrier embodying various features of the invention.

This disclosure of the invention is submitted in furtherance of the constitutional purposes of the U.S. Patent Laws "to promote the progress of science and useful arts" (Article 1, Section 8).

Shown in the various figures is a carrier assembly 10 for transporting and supporting fluorescent lamps 12 (FIG. 5), such as four foot long T12 or T8 lamps. The carrier assembly 10 (FIG. 1) includes a container 14 a flexible bag 16 and attachment means (described below in greater detail) for attaching the carrier assembly 10 to a ladder or other member. The flexible bag 16 has open and closed ends 18 and 20. The bag 16 has a length L between the open and closed ends 18 and 20, and the bag 16 defines a volume. While various materials could be employed, in the illustrated embodiment the bag 16 is a fabric bag. More particularly, in the illustrated embodiment, the bag 16 is formed of a poplin fabric. In alternative embodiments, the bag 16 is formed of an appropriate material resistant to cuts from broken glass, including but not limited to plastic, Tyvek (TM), paper, nylon, or cotton twill fabrics. While various sizes could be employed, in the illustrated embodiment the bag 16 has a length L of 32 inches, a width W of 10 inches, and a height H of 6 inches.

The container 14 further includes two parallel surfaces 24 and 26 spaced apart by panels 22. The container 14 is attached to the open end of the flexible bag 16. In one embodiment, container 14 is detachable from the bag 16, and includes male and female snap connectors 23 and 25 or other suitable fasteners mounted on panels 22 for removably connecting the container 14 to the open end 18 of the bag 16.

The surfaces 24 and 26 are both perpendicular to the length L of the bag 16. The first surface 24 has an array of lamp receiving apertures 28 therethrough. The second surface 26 also has an identical array of lamp receiving apertures 30 therethrough which are aligned with the apertures 28. While various numbers of apertures could be provided, in the illustrated embodiment each of the first and second surfaces has eleven apertures therethrough arranged in three rows, two of the rows having four apertures, and a middle row having three apertures. The apertures are sized to closely receive the lamps 12. In the illustrated embodiment the apertures 28 and 30 are 1 ⅝ inch diameter.

Each aperture 28 incorporates a coincident flap 46 attached to a small portion of the edge of the aperture. By the nature of the material, this flap is springably resilient within the aperture and pushes against the side of the lamp 12 impeding radial movement of the lamp 12 inserted through that aperture 28. One of the apertures in FIG. 1 is partly broken away to more clearly show one of the flaps 46. The second surface 26 similarly includes such resilient flaps 46. These flaps 46 substantially impede rattling of the lamps 12 as the carrier assembly 10 is transported. More particularly, the apertures 28 are formed by stamping the first surface 24 to form respective cuts in the first surface 24 to define the apertures 28. The cuts are not totally annular, and leave material connected between the first surface 24 and the flap 46. The connected material defines the flap 46 and bears against a lamp 12 because the connected material is being bent away from its natural position by the lamp. The apertures 30 through the second surface 26 are stamped in a manner similar to the apertures 28 through the first surface 24.

Thus configured, the tube support 14 supports and arranges the lamps 12 in parallel spaced apart relation wherein a portion of each lamp 12 extends into the volume in the bag 16 and a portion extends above the tube support 14.

The carrier assembly 10 further includes a handle 32 attached to the container 14 to facilitate transportation of the carrier assembly 10. In the illustrated embodiment, the carrying handle 32 is integral with the surface 24. In alternative embodiments, the handle may be an opening of similar shape pierced out of a surface of panel 22.

Figure 2:
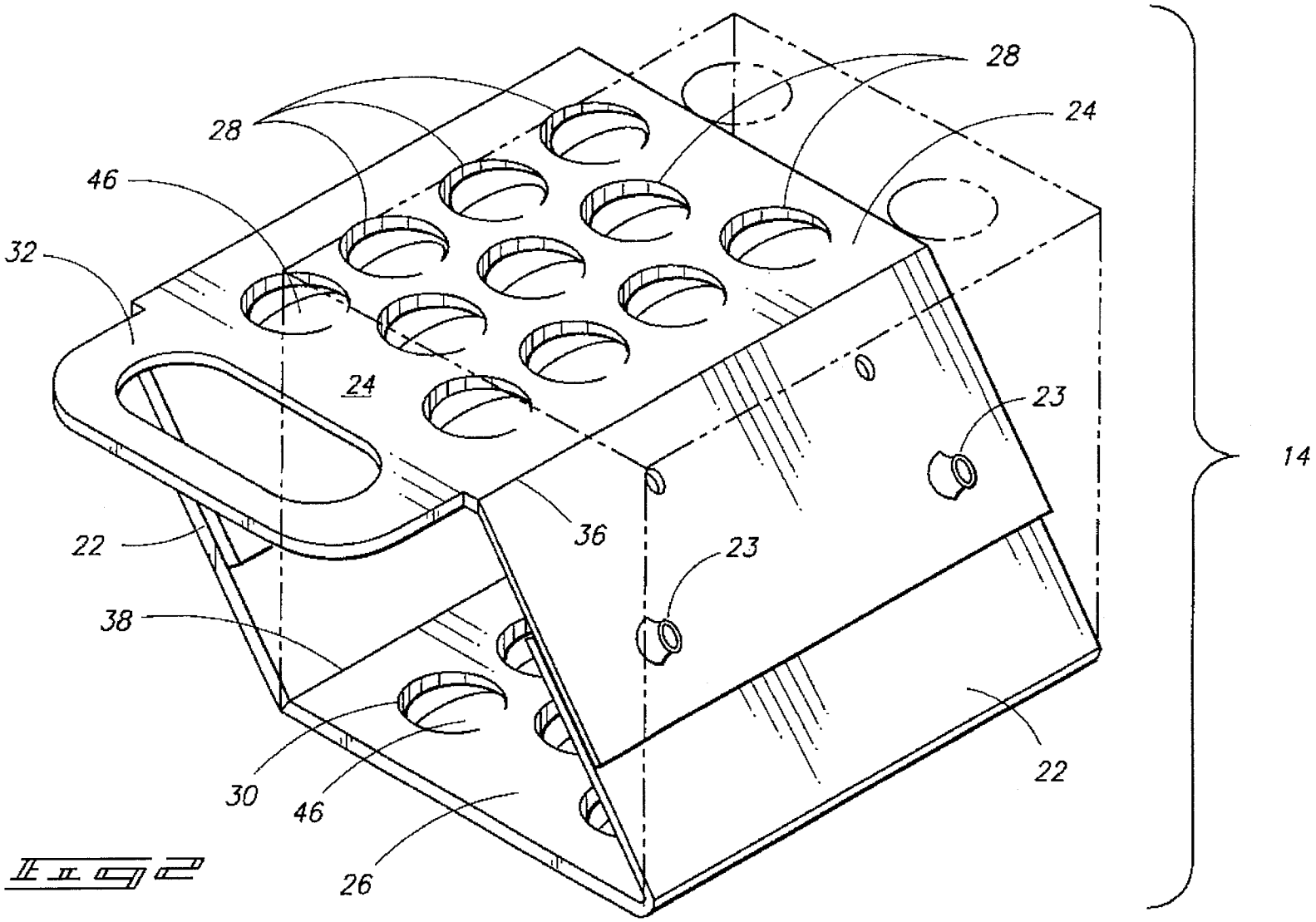
FIG. 2 is an enlarged, perspective view of a component of the lamp carrier of FIG. 1.

The tube support 14 is sufficiently rigid to separate and support the lamps and the bag 16. In the illustrated embodiment, the tube support 14 is fabricated of corrugated plastic sheet material. In alternative embodiments, the tube support 14 could be formed of corrugated cardboard, or other appropriate rigid materials. The tube support 14 is capable of being folded as a parallelogram along fold lines 36 and 38 (FIG. 2), so that the surfaces 24 and 26 are against each other, to provide compactness for shipping. The flexible nature of the bag 16 also provides compactness for shipping.

The carrier assembly 10 further includes cushion means in the bag 16, proximate the closed end 20 of the bag 16, for receiving connector pins 40 on the ends of lamps 12 inside the bag 16 for protection from end impact damage and for restraining against lateral movement relative to each other. While other means could be employed, in the illustrated embodiment the cushion means comprises a foam block 44 (FIG. 1) in the bag 16, adjacent the closed end 20 of the bag 16, and extending along the entire width and along the entire height of the volume in the bag. The connector pins 40 sink into the foam block 44.

The carrier assembly 10 further includes attachment means for attaching the carrier assembly 10 to a ladder 48, manlift, or other member, wherein the carrier assembly can be supported from a rung of the ladder or structural member of the manlift by the attachment means. While various other means could be employed, in the illustrated embodiment the attachment means comprises a strap 50 having a first end non-releasably connected at location 94 on panel 22 of the container 14, and having a second end terminating in a snap clip or hook 52 which removably engages a D-ring 54 attached at location 95 of panel 22 of the container 14 (FIG. 1). Thus, the strap 50 can be looped around a member of the ladder or a member of a manlift to support the carrier assembly 10 and its contents.

Figure 5:
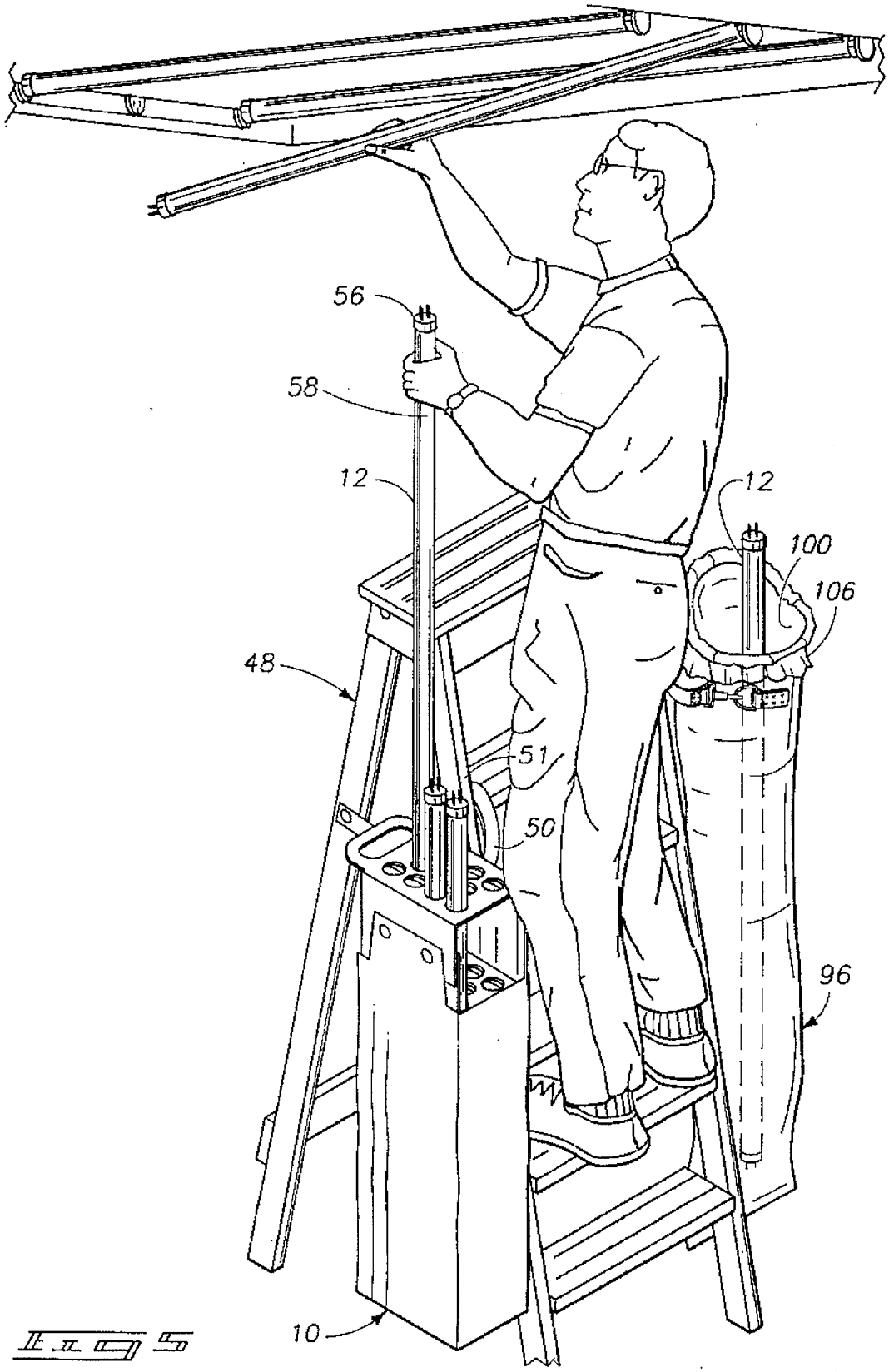
FIG. 5 is a perspective view illustrating use of the lamp carrier of FIG. 1 and the apparatus of FIG. 4.

The distance along the length direction from the closed end 20 of the bag to the first surface 24 is sufficiently long such that when a lamp 12 is supported by the carrier assembly 10 with one end of the lamp inserted into the bag 16 as far as possible, the other end 56 of the lamp is outside of the bag 16, beyond the tube support 14 (FIG. 5). Thus, the lamp 12 has an exposed portion 58, between the end 56 and the first surface 24 for easy removal from the container 14.

Figure 3:
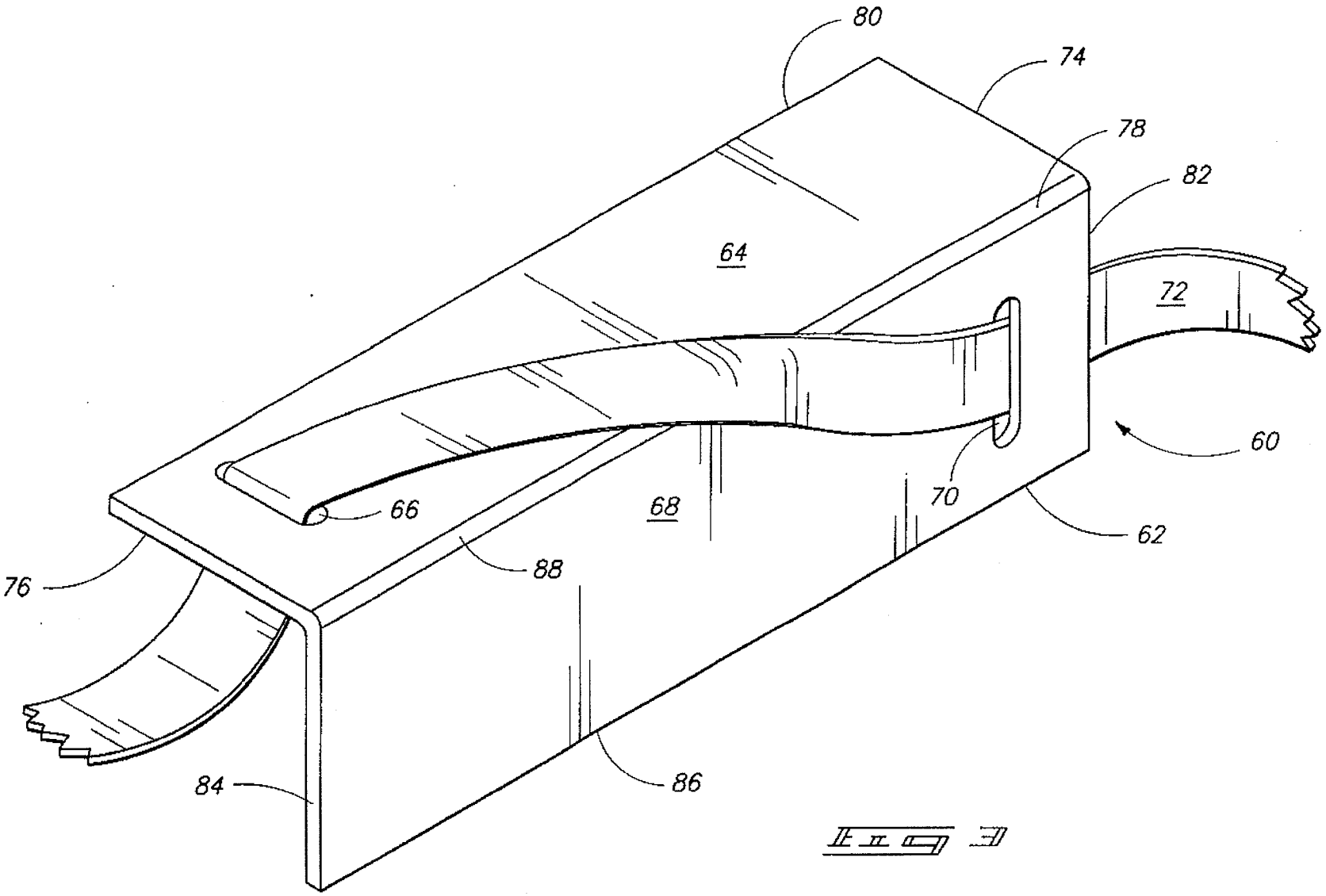
FIG. 3 is an enlarged, broken away, perspective view of a ladder hook optionally included in the lamp carrier of FIG. 1.

The carrier assembly 10 may optionally include a ladder hook 60 (FIG. 3) including an angle member 62 and a strap 72. The angle member 60 includes a first surface 64 including a slot aperture 66 therethrough. The angle member 62 further includes a second surface 68 including a slot aperture 70 therethrough. In the illustrated embodiment, the first and second surfaces 64 and 68 are perpendicular planar surfaces of sufficient length to span the fore/aft width of the top step of a typical step ladder. The strap 72 passes through the apertures 66 and 70 with each end fastened to the container 14 at locations 94 and 95.

The first surface 64 of the angle member 62 has first and second opposite ends 74 and 76, and the first surface 64 has a length between the first and second opposite ends 74 and 76. The first surface 64 further includes first and second opposite edges 78 and 80, and a width between the first and second opposite edges 78 and 80.

The second surface 68 of the corner member 62 has first and second opposite ends 82 and 84, and the second surface 68 has a length between the first and second opposite ends 82 and 84. The second surface 68 further includes first and second opposite edges 86 and 88. The second edge 88 of the second surface 68 meets or intersects the first edge 78 of the first surface 64 of the corner member. The first end 74 of the first surface 64 is proximate the first end 82 of the second surface 68 of the corner member 62. The aperture 66 through the first surface 64 is closer to the second end 76 than to the first end 74 of the first surface 64 of the corner member 62, and the aperture 70 through the second surface 68 of the corner member 62 is closer to the first end 82 than to the second end 84 of the second surface 68 of the corner member 62.

The aperture 66 through the first surface 64 of the corner member 62 is a slot elongated in the direction between the first and second edges 78 and 80 of the first surface 64 of the corner member 62. The aperture 70 through the second surface 68 of the corner member 62 is a slot elongated in the direction between the first and second edges 86 and 88 of the second surface 68 of the corner member 62.

The ladder hook 60 engages an end edge of a top step 89 of a ladder 48 (FIG. 1) opposite the side of the ladder against which the carrier 10 rests, to support the container 14 from a ladder. The diagonal arrangement of the apertures 66 and 70 aids in keeping the ladder hook 60 from slipping across or off of the top step of the ladder. The ladder hook 60 can also be employed by the user as a shoulder strap. In one embodiment, the carrier assembly comes only with strap 50 (the carrier assembly does not include ladder hook 60), and the ladder hook 60 is selectively installed (either in addition to or as a replacement for the strap 50), so that the ladder hook 60 can be sold as an accessory. In this embodiment, one end of the strap 72 terminates at the D-ring 54, and the other end of the strap 72 can be screwed to (or otherwise removably fastened to) the point 94 on the container 14 where the other end of the strap 50 is fastened.

Figure 4:
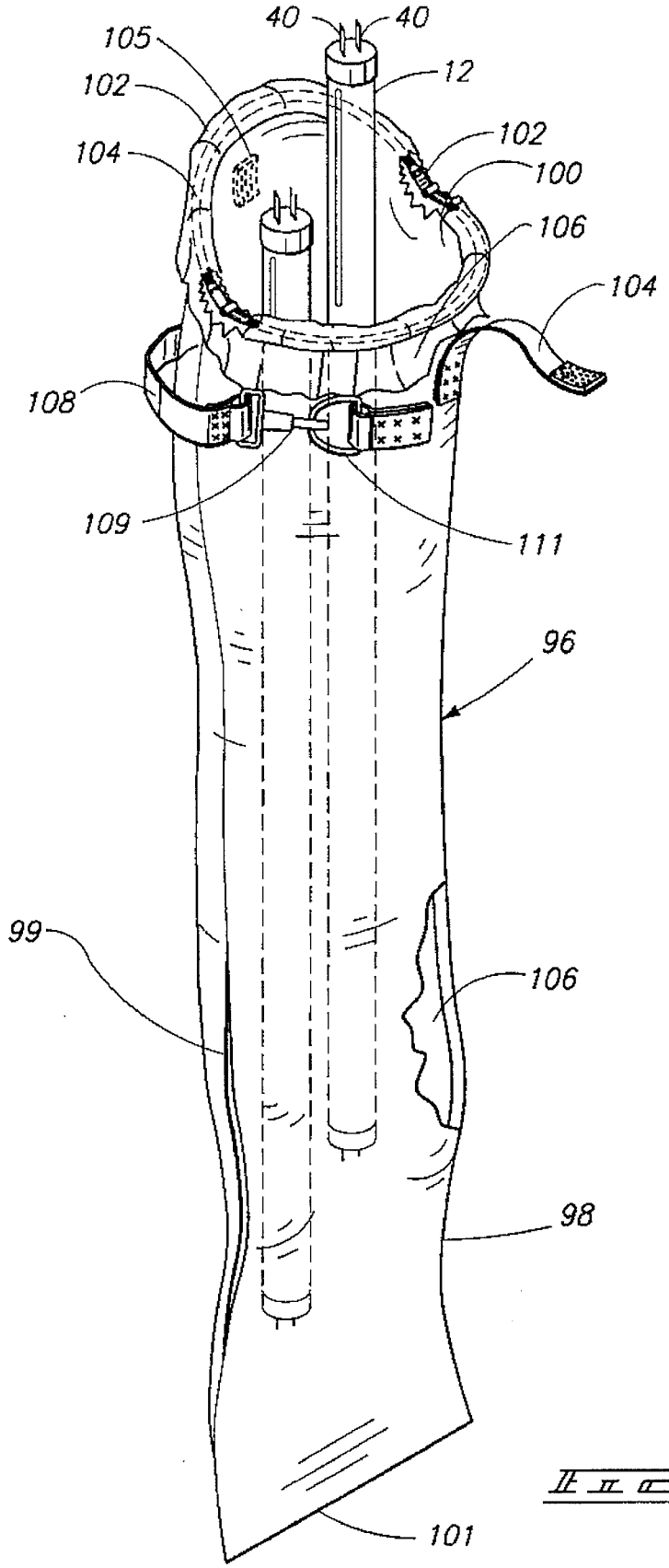
FIG. 4 is a perspective view, partly broken away, of an apparatus in accordance with one aspect of the invention for disposing of burned out fluorescent lamps (and also showing two lamps).

Also shown in the figures is an apparatus 96 for disposing of burned out fluorescent lamps (FIG. 4). The apparatus 96 includes an elongated flexible carrying bag 98 having an open or top end 100, and a closed or bottom end 101. The flexible carrying bag 98 is sized to entirely enclose and contain a plurality of fluorescent lamps 12. While other materials could be employed, in the illustrated embodiment the flexible carrying bag 98 is formed of a flexible material, thus providing compactness for shipping. While various flexible materials could be employed, in the illustrated embodiment the bag 98 is a fabric bag. More particularly, in the illustrated embodiment, the bag 98 is formed of an appropriate material resistant to cuts from broken glass, including but not limited to plastic, nylon, poplin, cotton twill or Naugahyde™.

The bag 98 further includes means for selectively closing the top end 100. While other means could be employed, in the illustrated embodiment the closing means comprises a spring loaded metal purse frame 102 including a pair of generally semi-circular members hinged together and movable between an open position (FIG. 4), where the semi-circular members form an annular shape, and a closed position (FIG. 6), where the semi-circular members are adjacent one another. When in the open position, the spring loaded frame 102 stays open by itself, thus providing for one handed insertion or removal of items into or out of the bag 98. Such a spring loaded frame is commonly used to close womens' purses. For example, such purse frames are sold under the trademark "FA-CILE". In an optional embodiment, the closing means further comprises Velcro (trademark) strap fastener 104 and interengaging Velcro patch 105 fastening closed the top end 100 when the frame 102 is in the closed position.

The bag 98 also incorporates a vertical side opening 99 which begins a short distance (e.g., 8 inches) from the bottom end 101, and extends upwardly (e.g., 12 inches) toward the top end 100.

The disposal apparatus 96 further includes a disposable flexible liner bag 106 which is used to line the bag 98. The liner bag 106 is stronger than a typical garbage bag. For example, in the illustrated embodiment, the liner bag 106 is formed of a heavy gauge polyethylene or similar homogeneous plastic sheet.

The disposal apparatus 96 further includes a strap 108 having a first end attached to the bag 98, and having a second end with a snap clip or hook 109 that selectively engages a D-ring 111 attached to the bag 98. The strap 108 is used for attaching the apparatus 98 to a member of a ladder or man-lift cage. The strap 108 can also be used as a carrying handle.

In operation (FIG. 5), the bag 98 of apparatus 96 is lined with a disposable flexible liner bag 106 and the carrier assembly 10 is loaded or stocked with fresh (working) lamps 12. The carrier assembly 10 and the apparatus 96 are then transported to a ladder 48 positioned underneath a light fixture, and are attached to the side legs of the ladder 48. (In the event that the carrier assembly 10 includes the optional ladder hook 60, the ladder hook 60 is positioned on the top step as shown in FIG. 1, instead of attaching the carrier assembly to the side leg of the ladder 48 using strap 50). Then, the user ascends the ladder and one or more burned out fluorescent lamps 12 are removed from the light fixture and inserted into the disposal apparatus 96. Fresh lamps are removed from the carrier assembly 10 and are inserted into the light fixture where the burned out lamps used to be.

Figure 6:
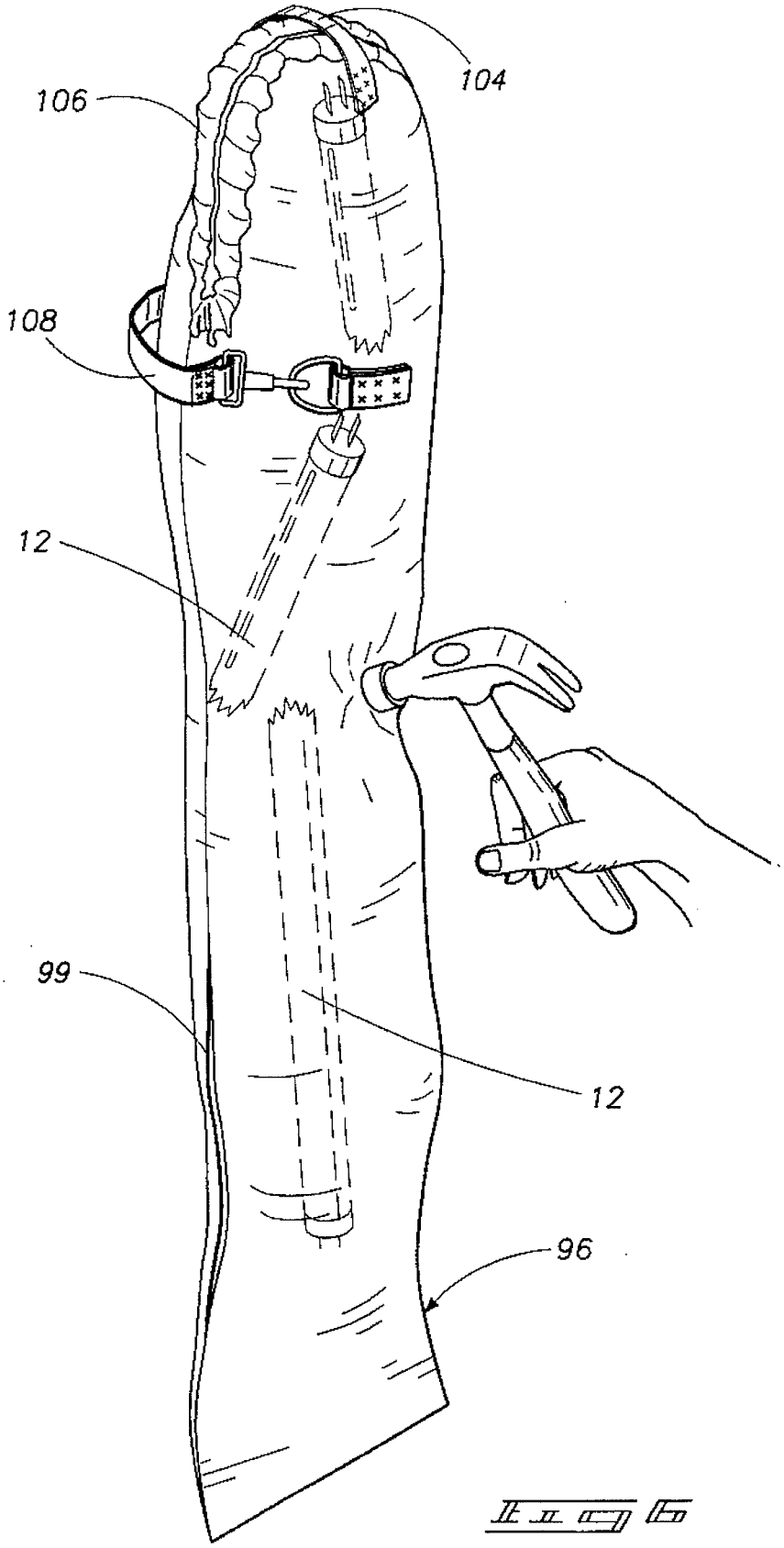
FIG. 6 is a perspective view illustrating breaking of burned out lamps contained in the apparatus of FIG. 4 prior to disposal.

The carrier assembly 10 and the disposal apparatus 96 are then transported with the ladder to the next fixture requiring change-out, and the process is repeated until the supply of lamps in the carrier assembly 10 are exhausted, and the disposal apparatus 96 is full (in the illustrated embodiment, the disposal apparatus 96 accommodates up to ten lamps). When the disposal apparatus 96 is full, or there are no more lamps to change, the top end 100 is closed, and a breaking force is applied several times along the length of the disposal apparatus 96 to break the burned out fluorescent lamps inside (FIG. 6). The disposal apparatus 96 is then held vertically proximate the top end 100 and shaken to send all the rubble inside to the bottom.

Then, the closing means or frame 102 is operated to open the end 100 of the flexible carrying bag 98.

Figure 7:
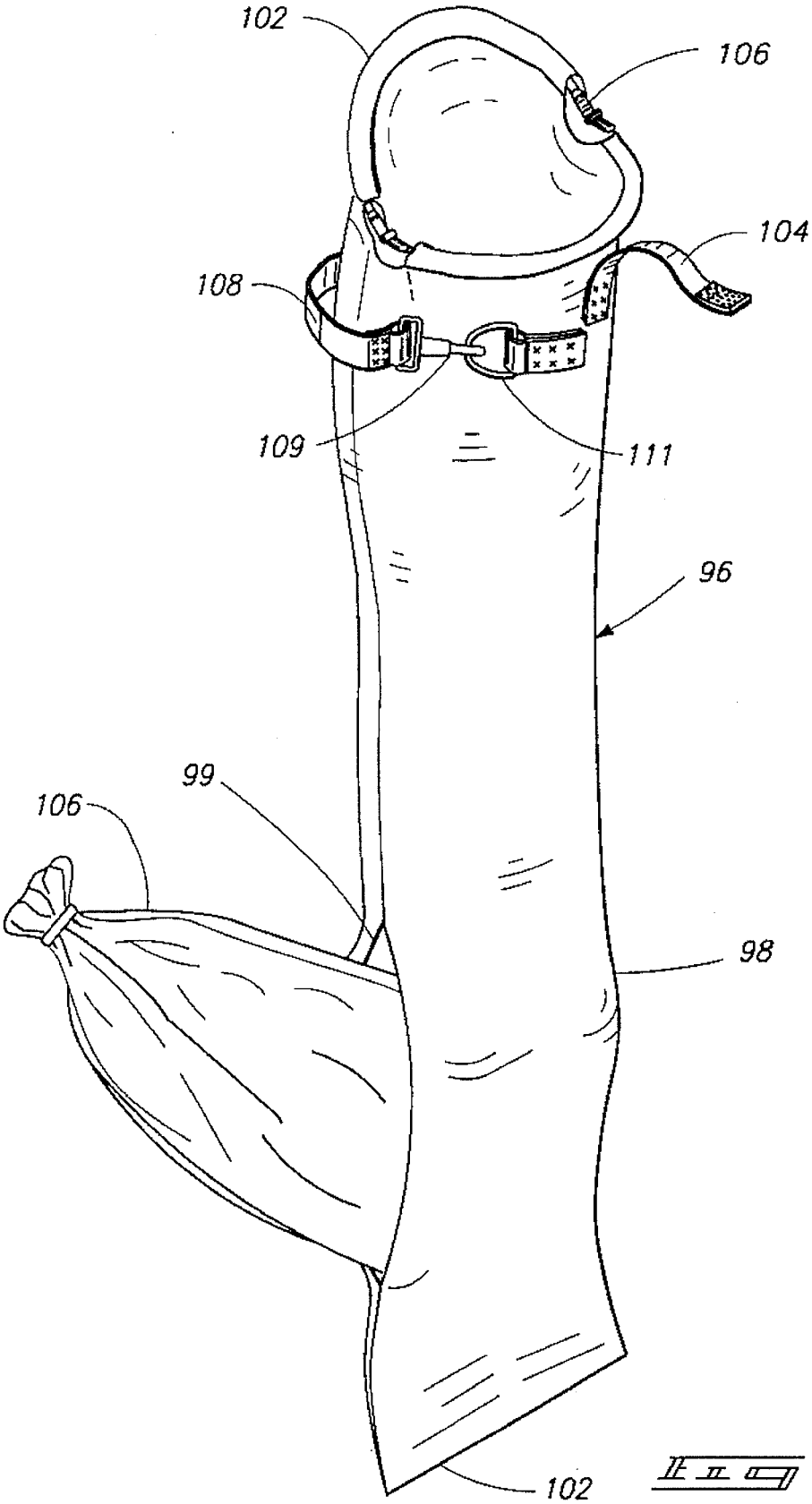
FIG. 7 is a perspective view illustrating removal of a liner bag of the apparatus of FIG. 4 for disposal of broken pieces of burned out lamps.

Reaching inside the side opening 99, the top of the flexible liner bag 106 is released from the top opening 100 and pulled down and out of the carrying bag 98. The flexible liner bag 106 is knotted and removed from the flexible carrying bag 98 via the opening 99 (FIG. 7). The flexible liner bag 106 and its broken contents are disposed of in an appropriate disposal receptacle.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A carrier assembly for transporting and supporting linear fluorescent lamps, the carrier assembly comprising:

a container including a flexible bag having open and closed ends, the bag having a length between the open and closed ends, and the bag defining a volume; and the container including a tube support, the tube support including first and second parallel spaced apart surfaces, the first and second surfaces being perpendicular to the length of the bag, the first surface having an array of lamp receiving apertures therethrough, the second surface having an array of lamp receiving apertures therethrough which are aligned with the apertures through the first surface, the tube support being attached to the open end of the flexible bag to support and arrange a plurality of fluorescent lamps in spaced apart relation wherein portions of respective lamps extend into the volume in the bag.

2. A carrier assembly in accordance with claim 1 and further comprising a carrier handle attached to the container.

3. A carrier assembly in accordance with claim 2 wherein the carrying handle is integral with the tube support.

4. A carrier assembly in accordance with claim 2 wherein the carrying handle is integral with the tube support and defines a surface parallel to the first and second surfaces.

5. A carrier assembly in accordance with claim 1 wherein the tube support is detachable from the bag.

6. A carrier assembly in accordance with claim 1 and further comprising snap connectors selectively attaching the tube support to the bag.

7. A carrier assembly in accordance with claim 1 wherein the tube support is rigid.

8. A carrier assembly in accordance with claim 1 and further comprising cushion means in the bag, proximate the closed end of the bag, for receiving connector pins of ends of a plurality of lamps and for restraining the ends of the lamps against movement relative to each other.

9. A carrier assembly in accordance with claim 1 wherein the volume in the bag has a width perpendicular to the length of the bag, wherein the volume in the bag has a height perpendicular to the length of the bag and perpendicular to the width of the bag, and wherein the carrier assembly further comprises a foam cushion in the bag, adjacent the closed end of the bag, and extending along the entire width and along the entire height of the volume in the bag.

10. A carrier assembly in accordance with claim 1 wherein the first surface comprises resilient means extending from respective apertures through the first surface, the resilient means impeding radial movement of lamps inserted through the apertures.

11. A carrier assembly in accordance with claim 10 wherein the second surface comprises resilient means extending from respective apertures through the second surface, the resilient means impeding radial movement of lamps inserted through the apertures.

12. A carrier assembly in accordance with claim 1 wherein the apertures through the first surface are formed by stamping the first surface to form respective cuts in the first surface to define respective apertures, wherein the cuts are not annular and leave material connected to the first surface, and wherein the connected material bears against lamps inserted through the apertures to impede rattling of the lamps.

13. A carrier assembly in accordance with claim 12 wherein the apertures through the second surface are formed by stamping the second surface to form respective cuts in the second surface to define respective apertures, wherein the cuts are not annular and leave material connected to the first surface, and wherein the connected material bears against lamps inserted through the apertures to impede rattling of the lamps.

14. A carrier assembly in accordance with claim 1 and further comprising an attachment strap having a first end non-removably connected to the container and having a second end removably connected to the container.

15. A carrier assembly in accordance with claim 1 wherein the tube support has third and fourth parallel spaced apart surfaces connecting together the first and second surfaces, the third and fourth surfaces both being perpendicular to the first and second surfaces, the carrier assembly further comprising attachment means for attaching the carrier assembly to a ladder wherein the carrier assembly can be supported from a rung of the ladder by the attachment means, the attachment means comprising a strap having a first end fastened to the third surface, and having a second end terminating with a snap clip, and the attachment means further including a ring fastened to the third surface, the clip selectively engaging the ring.

16. A carrier assembly in accordance with claim 1 wherein distance along the length direction from the closed end of the bag to the first surface is sufficiently long such that when a four foot long lamp is supported by the carrier assembly with one end of the lamp inserted into the bag as far as possible, the other end of the lamp is outside of the bag, beyond the tube support.

17. A carrier assembly for transporting and supporting fluorescent lamps, the carrier assembly comprising:

a container including a flexible bag having open and closed ends, the bag having a length between the open and closed ends, and the bag defining a volume; and the container including a tube support, the tube support including first and second parallel spaced apart surfaces, the first and second surfaces being perpendicular to the length of the bag, the first surface having an array of lamp receiving apertures therethrough, the second surface having an array of lamp receiving apertures therethrough which are aligned with the apertures through the first surface, the tube support being attached to the open end of the flexible bag to support and arrange a plurality of fluorescent lamps in spaced apart relation wherein portions of respective lamps extend into the volume in the bag; and a ladder hook including a corner member having a first surface including an aperture therethrough, and the corner member having a second surface including an aperture therethrough, the second surface of the corner member being perpendicular to the first surface of the corner member, and the ladder hook further comprising a strap passing through the apertures through the first and second surfaces of the corner member and the strap having opposite ends, each end of the strap being fastened to the container.

18. A carrier assembly in accordance with claim 17 wherein the first surface of the corner member has first and second opposite ends, a length between the first and second opposite ends, and first and second opposite edges, and a width between the first and second opposite edges, wherein the second surface of the corner member has first and second opposite ends, a length between the first and second opposite ends, and first and second opposite edges, wherein the second edge of the first surface meets the first edge of the second surface of the corner member, wherein the first end of the first surface is proximate the first end of the second surface of the corner member, wherein the aperture through the first surface of the corner member is closer to the second end than to the first end of the first surface of the corner member, and wherein the aperture through the second surface of the corner member is closer to the first end than to the second end of the second surface of the corner member.

19. A carrier assembly in accordance with claim 18 wherein the aperture through the first surface of the corner member is a slot elongated in the direction between the first and second edges of the first surface of the corner member, and wherein the aperture through the second surface of the corner member is a slot elongated in the direction between the first and second edges of the second surface of the corner member.

* * * * *